United States Patent [19]

Ellefson

[11] 4,036,132

[45] July 19, 1977

[54] LABEL STRIPPING APPARATUS FOR LABEL PRINTERS

[75] Inventor: Larry P. Ellefson, Seattle, Wash.

[73] Assignee: Interface Mechanisms, Inc., Mountlake Terrace, Wash.

[21] Appl. No.: 631,743

[22] Filed: Nov. 13, 1975

[51] Int. Cl.[2] ..... B41F 1/08

[52] U.S. Cl. ..... 101/288; 221/73

[58] Field of Search ..... 101/288-295, 101/138-139, 178-182, 219-220, 253; 197/133 R, 133 T; 221/69-74

[56] References Cited

U.S. PATENT DOCUMENTS

| | | | |
|---|---|---|---|
| 2,522,224 | 9/1950 | Hedinger | 101/288 |
| 3,128,012 | 4/1964 | Berg | 221/70 |
| 3,656,430 | 4/1972 | Olsson | 101/288 |
| 3,696,967 | 10/1972 | Moore | 221/73 |

*Primary Examiner*—Edgar S. Burr
*Assistant Examiner*—A. Heinz
*Attorney, Agent, or Firm*—Christensen, O'Connor, Garrison & Havelka

[57] ABSTRACT

A label printer is disclosed for imprinting characters in succession on label stock comprising an elongated strip of label stock backing having a front surface and a back surface and further comprising a plurality of labels removably adhering to and spaced along the front surface of the elongated strip. The label printer takes the label stock from a supply position, passes it in a first direction by a print station, then passes the label stock with the imprinted labels through a label stripping apparatus which includes a first pin mounted so as to extend transversely to the first direction of label stock travel and bearing against the back surface of the label stock backing. The label printer draws the label stock from the label stripping apparatus in a second direction which is substantially at right angles to the first direction so as to result in separation of individual imprinted labels as the label stock passes around the first pin. To avoid imprecision in the characters that are being imprinted at the print station, due to slack in the elongated strip caused when the label stock backing passes around the first pin and bulges away therefrom, a second pin is located to apply pressure to the front surface of the elongated strip at a point where the elongated strip is travelling in the second direction after passing around the first pin.

9 Claims, 6 Drawing Figures secured to support member 60 by a plurality of fasteners 68. A hammer 64 is movable between first and second guide plates 62, 66 in a direction toward the print wheel 12 and at some point in its travel engages the back surface of a label stock backing S to press one of a plurality of labels L1, L2 or L3 removably adhering to the front surface of label stock backing S and an interposed ink ribbon R (FIG. 1) against one of the raised elements on print wheel 12 to thereby imprint a character on the label. Hammer 64 is caused to move by a solenoid 74 mounted in support member 60 and an associated arm assembly, not illustrated, and its return movement after imprinting is cushioned by a damper assembly 72. The hammer mechanism 14 is completed by a housing 70 overlying the stop surfaces of elements 60, 62 and 66 and the right side surface of element 66, and and is secured to a support plate 11 by a plurality of fasteners 76. Support plate 11, in turn, is secured to base plate 10, by means not illustrated.

With reference now back to FIG. 1, the label stock including the label stock backing S is obtained from a label stock supply reel 16 which is rotatably supported on a shaft 18 mounted on base plate 10. From the label stock supply reel 16, the label stock is first drawn around a supply tension roller 20 also supported on base plate 10 and from there past a guide member 22, a label stock sensor 24, and a guide member 26 to the print station. As can be seen from FIG. 2, the label stock can be seen to be travelling in a first direction D1 at the print station including hammer mechanism 14. Immediately after leaving the print station, the label stock is caused to change its direction to a second direction D2 spaced substantially 90° from first direction D1 by a drive capstan 30 which presses the label stock against a label stripping apparatus designated by the numeral 28, to be explained in more detail hereinafter. The drive capstan 30 is rotated by a drive capstan motor, not illustrated, mounted below the base plate 10. The label stock is maintained into engagement of the drive capstan 30 by a pinch roller 32 pivoted on the base plate 10.

From the drive capstan 30, the label stock passes around a take-up tension roller 34 mounted on base plate 10 and then onto a take-up reel 36 which is rotatable on a shaft 38 of a take-up drive motor, not illustrated.

The ink ribbon R is similarly obtained from a ribbon supply reel 40 which is rotatable on a shaft 42 affixed to the base plate 10. From the ribbon supply reel 40, the ink ribbon R passes around a supply roller 44, a guide pin 46, through the print station including hammer mechanism 14 and print wheel 12, and to a guide pin 48. Roller 44, guide pin 46 and guide pin 48 are all mounted on base plate 10. From guide pin 48, the ink ribbon R passes around a drive capstan 50 which is rotated by a drive capstan motor, not illustrated, and is pressed against drive capstan 50 by a pinch roller 52 mounted on base plate 10. From drive capstant 50, the ink roller R is taken up on a ribbon take-up reel 54 which is rotatable with the shaft 56 of a ribbon driven motor, not illustrated.

As is conventional in the prior art, electronic control means is provided for controlling the rotation of drive capstans 30, 50 to provide movement of successive labels L on the label stock backing S, and a corresponding movement of the ink ribbon R, past the print station. Electronic control means is likewise provided for coordinating the movement of hammer 64 within hammer mechanism 14 with the rotation of print wheel 12 under control of timing signals obtained from print wheel 12 to provide imprinting of selected characters on the labels.

The label stripping apparatus 28 is seen (FIGS. 2, 3, and 6), to comprise a base member 80 having first and second surfaces for engaging the left side surface 60A and front surface 60B of the support member 60 in the hammer mechanism 14. A plurality of fasteners 82 pass through corresponding apertures in base member 80 to secure base member 80 to the support member 60. Base member 80 includes a substantially planar upper surface 80A which is parallel with a plane defined by the first and second directions, D1, D2, of label stock movement. First and second, cylindrical pins 86, 84 are upstanding from and extend at right angles from surfaces 80A and are accordingly situated in assembly transverse to the first and second directions D1, D2 of label stock movement. Both pins 84 and 86 are appropriately secured in base member 80. The longitudinal centers of pins 84 and 86 are separated in a direction substantially parallel to the first direction D1 by an amount *b* and in a direction substantially parallel to the second direction D1 by an amount *a.* As can be seen particularly from FIG. 3, pin 86 extends for a slightly longer distance above surface 80A of base member 80 than does pin 84.

As the label stock backing S passes around and with its back surface in contact with pin 86, a label L removably adhering to the front surface of the label stock backing S will separate therefrom as illustrated in the drawings. As best seen in FIG. 6, a portion of the cylindrical surface of pin 86 functions as a label stripping surface. The change in direction of the label stripping surface must be abrupt enough with conventional label stock tensions to achieve label separation. With label stock tensions in the range of 200–400 grams (provided by drive capstan 30 and supply tension roller 20 in the embodiment of FIG. 1) the maximum radius of the pin 86, and therefore the maximum radius of curvature of the label stripping surface, should be no more than 0.063 inches. It will be readily appreciated by those skilled in the art that the ideal, although impractical, label stripping surface would comprise an edge surface having a discontinuous change in surface direction.

With reference now to FIG. 4, let it be assumed that the label stripping apparatus 28 illustrated in FIGS. 2, 3 and 6 has been replaced by a similar label stripping apparatus again including a base member 80 with a single pin 88 extending therefrom in the precise location of pin 86 and with the same radius. As discussed, the pin 88 will provide reliable separation of labels L from the label stock backing S. However, it can be noted from FIG. 4 that the label stock backing S, when it leaves the label stripping surface provided by pin 88 in the direction D2, pulls away or "bulges" from the direction D2 for a short distance. The bulge arises from the fact that the label stock backing S cannot conform, with conventional label stock tensions, to the change of direction attempted to be imposed on it by the small radius of pin 88. It has been discovered that this bulge in the label stock backings is a cause of imprecise printing of characters, inasmuch as the label stock backing is permitted to shift slightly during impacting of the hammer 64 in the hammer mechanism 14 against the label stock backing 5, label L, ink ribbon R and print wheel 12. Viewed in another way, the bulge results in unpredictable length of the label stock backing 5 between a supply position at the centerline of the print station and a take-up position

LABEL STRIPPING APPARATUS FOR LABEL PRINTERS

FIELD OF THE INVENTION

This invention generally relates to the field of label printers, and more specifically, to label stripping apparatus useful in conjunction with such label printers.

BACKGROUND OF THE INVENTION

Mechanical impact printers are known to the prior art for imprinting a succession of characters, which may be expressed in the form of a bar code or the like, on a succession of labels which removably adhere to an elongated strip of label stock backing. In such printers, the elongated strip is moved under tension in a first direction past a print station where the characters are successively imprinted. The imprinted label stock may then be wound onto a take-up reel for subsequent dispensing of the imprinted labels. In certain cases, it is desired to remove the imprinted labels immediately after imprinting. To this end, the prior art has provided label stripping apparatus which may comprise a guide member having a projection or the like forming a label stripping surface around which the label stock is passed after imprinting. If the direction of label stock movement is changed by substantially 90° as it passes around the label stripping surface, and if the label stripping surface is formed by a projection or other sufficiently sharp surface, the individual labels will separate from the label stock backing at the label stripping surface and can thereafter be completely removed from the label stock backing by hand.

It has been ascertained that the use of such label stripping apparatus adversely affects the control of the pitch of the printed characters, e.g., the space between adjacent characters. In the case where the characters represent successive bars of a bar code, in which case both the bars and the spaces between them may contain information, such misprinting or pitch variation can result in certain cases in incorrect code information being imprinted.

It is therefore an object of this invention to provide a label stripping apparatus for label printers which results in reliable separation of individual labels from a label stock backing and which additionally allows for accurate and precise imprinting of characters on the labels before separation.

It is a further object of this invention to provide such a label stripping apparatus which is simple in construction and which requires no maintenance in its operation.

SUMMARY OF THE INVENTION

Briefly, these objects and others which will be realized by consideration of the following portion of the specification are realized by a label-stripping apparatus for use with label stock comprising an elongated strip of label stock backing having a front surface and a back surface and further comprising a plurality of labels removably adhering to and spaced along the front surface of the elongated strip. The label stripping apparatus includes first means having a label stripping surface capable of causing the labels to separate from the front surface of the elongated strip of label stock backing when the back surface thereof is moved across the label stripping surface in the direction of the elongated strip. Second means are provided for moving the elongated strip of label stock backing under tension from a supply position to a take-up position. The second means is located with respect to the first means so that the back surface of the elongated strip of label stock backing is pressed against the label stripping surface and the elongated strip of label stock backing is caused to travel in a first direction from the supply position to the label stripping surface, around the label stripping surface, and in a second direction, spaced substantially 90° from the first direction, from the label stripping surface to the take up position. The first means further includes a backing pressure surface which is substantially aligned with the portion of the label stripping surface in proximity to the take-up position. The backing pressure surface is spaced apart from the label stripping surface in the second direction and located between the label stripping surface and the take-up position for engaging the front surface of the elongated strip of label stock backing to maintain the back surface of the elongated strip of label stock backing in contact with the label stripping surface at all times. The separation or spacing between the backing pressure surface and the label stripping surface in the second direction is such so as to result in substantially constant length of the elongated strip of label stock backing being maintained at all times between the supply position and the take-up position, resulting in accurate and precise imprinting of characters at a print station located at the supply position.

In a preferred embodiment, the first means comprises a first pin extending transversely to the first and second directions, a portion of the surface of the first pin forming the label stripping surface. The first means may further comprise a second pin extending transversely to the first and second directions, which second pin is spaced from the first pin. A portion of the surface of the second pin forms the backing pressure surface.

BRIEF DESCRIPTION OF THE DRAWINGS

The invention can best be understood by reference to the following portion of the specification, taken in conjunction with the accompanying drawings, in which.

DESCRIPTION OF A PREFERRED EMBODIMENT

Figure 1:
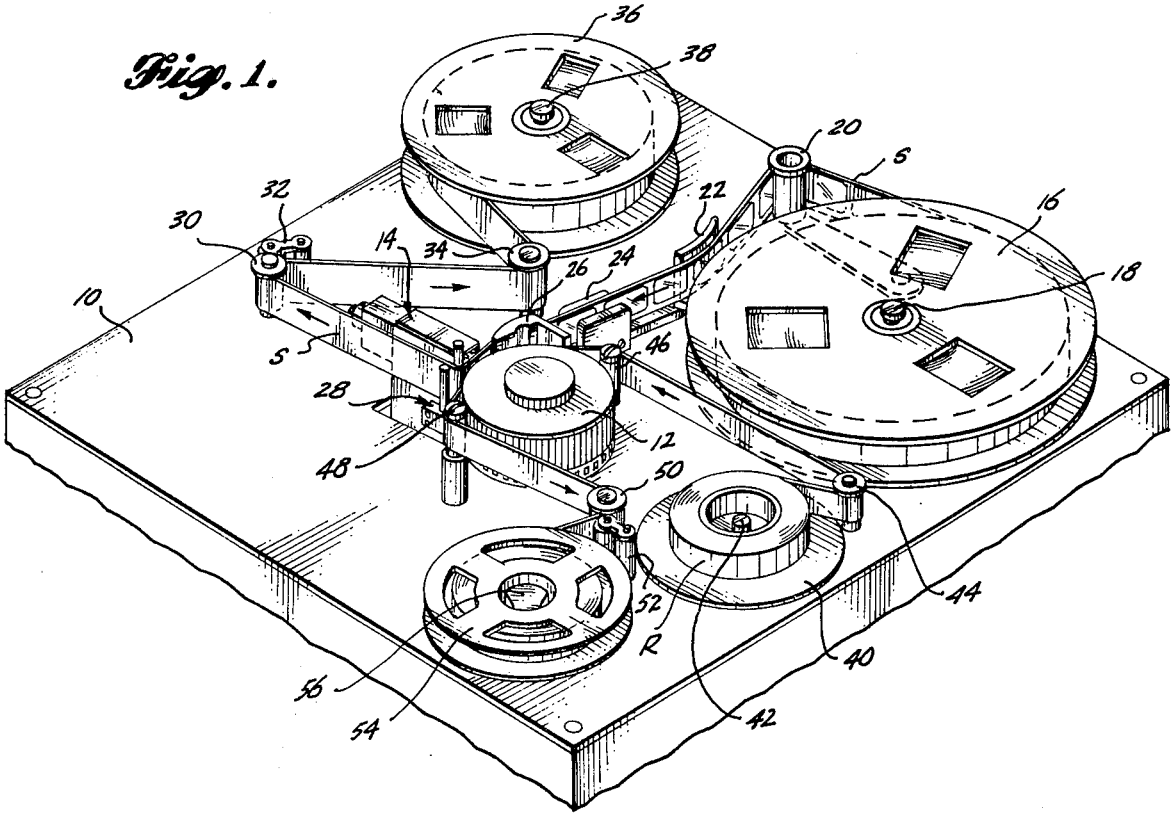
FIG. 1 is a pictorial view of a label printer including the label stripping apparatus of the present invention.

Referring now to FIG. 1, a label printer includes a base plate 10 above which a print wheel 12 is supported for rotation. The circumferential surface of print wheel 12 has located thereon a plurality of raised elements representing the characters to be imprinted and is continuously rotated by a drive means, not illustrated. A hammer mechanism 14 is located in proximity to print wheel 12 and together with print wheel 12 forms a print station.

Figure 2:
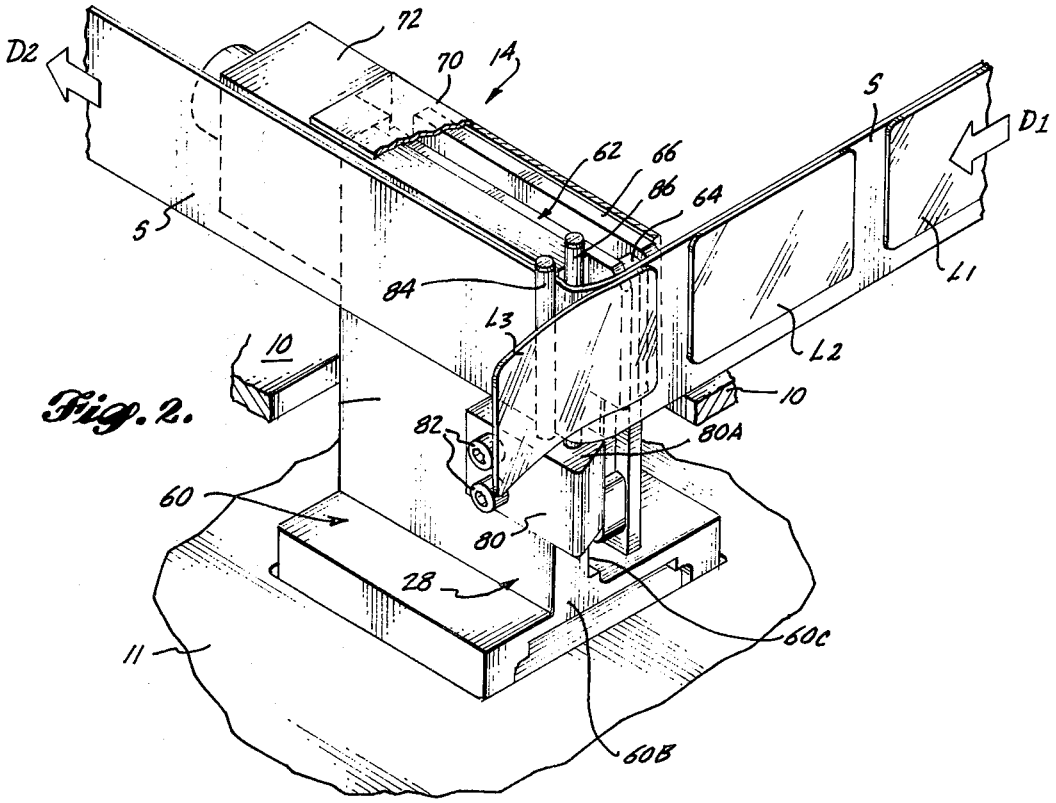
FIG. 2 is a magnified pictorial view of the portion of the label printer in FIG. 1 including the label stripping apparatus.
Figure 3:
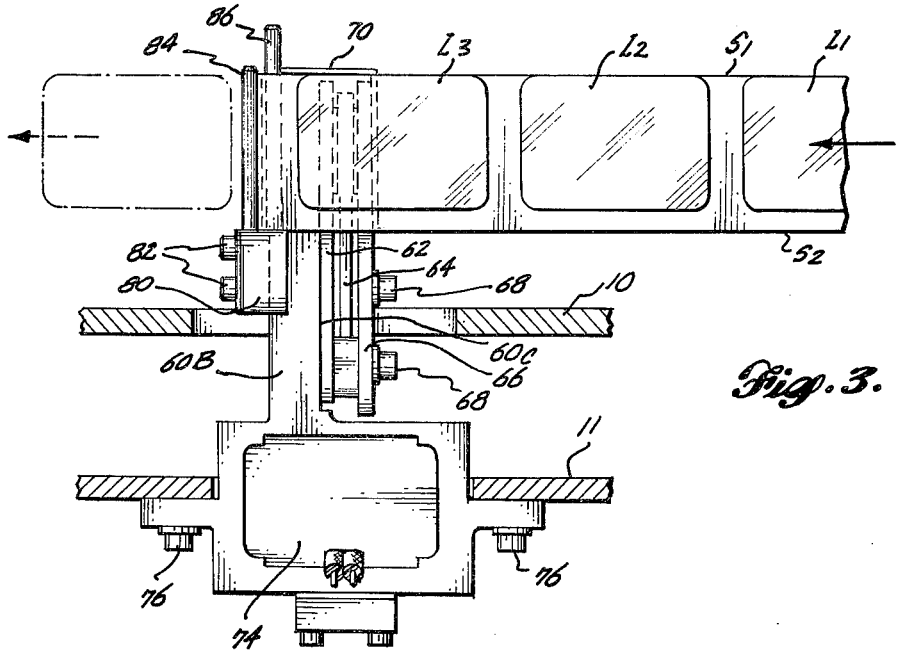
FIG. 3 is front elevational view of the label stripping apparatus depicted in FIG. 2.
Figure 4:
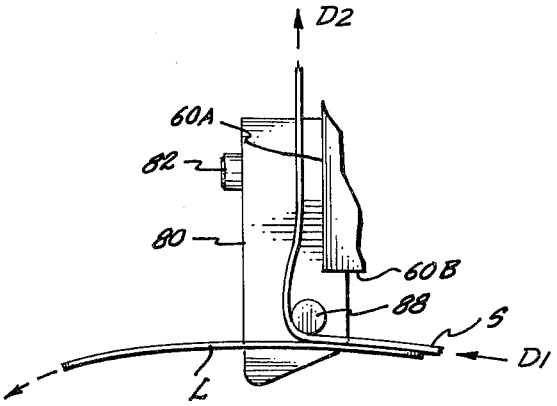
FIGS. 4, 5 and 6 are plane views showing respectively, three embodiments of a label stripping apparatus.

Referring now to FIGS. 2 and 3, the hammer means 14 is seen to comprise a support member 60 which includes a left side surface 60A, a front surface 60B which faces the print wheel 12, and a right side surface 60C. A first guide plate 62 abuts right side surface 60C and is secured to support member 60. A second guide plate 66 is spaced apart from first guide plate 62 and is likewise at the points of contact between drive capstan 30 and the pinch roller 32.

The bulge can be minimized or eliminated by increasing the label stock tension beyond the values previously specified. However, this approach is disadvantageous in that it leads to increased label stock breakage and additionally requires more expensive and bulkier drive capstan motors and a corresponding increase in power consumption.

Figure 5:
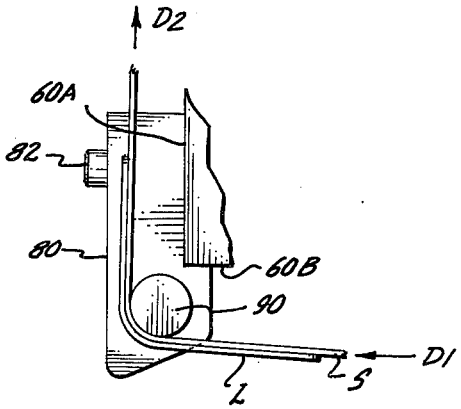
Figure 6:
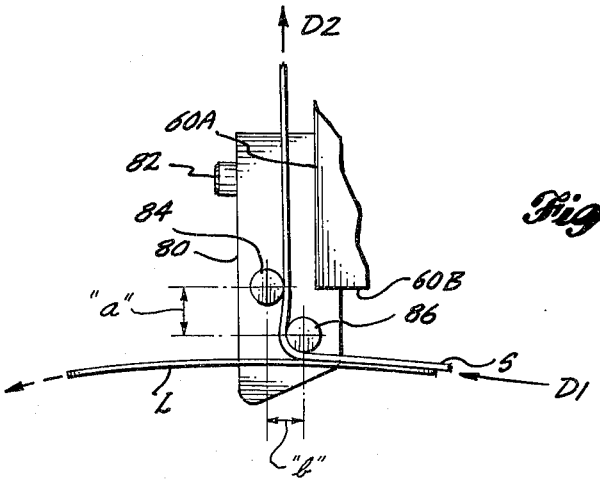

Another approach to minimizing or eliminating the bulge is that shown in FIG. 5, in which case the diameter of the pin having the label stripping surface is increased, such as typified by pin 90 in FIG. 5. However, as also indicated in FIG. 5, an increase in the diameter of the pin having the label stripping surface often results in unreliable separation of the labels L from the label stock backing S.

The present invention accordingly contemplates the provision of the second pin 84 which is spaced with respect to the first pin 86 so as to engage the front surface of the label stock backing S to force the back surface thereof to conform to the label stripping surface for substantially 90°, or the amount of direction change between the first and second direction D1, D2. It will accordingly be seen that a portion of the surface of pin 84 functions as a backing pressure surface to eliminate the bulge in label stock backing S and accordingly provide a substantially constant length of the label stock backing as it passes through the print station between the supply and take-up positions.

In a working model of the invention, the pins 84 and 86 both comprised heat-treated steel pins having a diameter of 0.125 inches. The separation *a* comprised 0.160 inches and the separation *b* comprised 0.135 inches. In this case, the backing pressure surface provided by pin 84 was substantially aligned with the portion of the label stripping surface extending in the second direction D2. If the separation *b* is decreased, below an amount slightly greater than the diameter of pin 86, reliable stripping will result but an increase in thension applied to the label stock will be necessary, and if the separation *b* is increased, a bulge resulting in misprinting will appear and increase. The separation *a*, on the other hand, must be empirically determined.

Although the pin 86 is depicted, specifically with reference to FIG. 3, as extending further above the surface 80A of base member 80 than does pin 84, such an arrangement is for convenience only in allowing easier insertion of the label stock between pins 84 and 86 when threading the label stock in the printer and forms no part of the present invention.

While the invention has been described with reference to a preferred embodiment, it is to be clearly understood by those skilled in the art the invention is not limitd thereto, but rather is intended to be bounded only by the limits of the appended claims.

I claim:

1. A label-stripping apparatus for use with label stock comprising an elongated strip of label stock backing having a front surface and a back surface and further comprising a plurality of labels removably adhering to and spaced along the front surface of the elongated strip, said apparatus including:

a. first means having a label stripping surface capable of causing the labels to separate from the front surface of the elongated strip of label stock backing when the back surface thereof is moved across said label stripping surface in a longitudinal direction of the elongated strip, b. second means for moving the elongated strip of label stock backing under substantially uniform tension from a supply position to a take-up position and located with respect to said first means so that the back surface of said elongated strip of label stock backing is pressed against said label stripping surface and the elongated strip of label stock backing is caused to travel in a first direction from said supply position to said label stripping surface, across said label stripping surface, and in a second direction, angularly disposed substantially 90° from said first direction, from said label stripping surface to said take-up position, c. said first means further including a backing pressure surface which is located between said label stripping surface and said take-up position in proximity to said label stripping surface for engaging the front surface of the elongated strip of label stock backing after the elongated strip travels across said label stripping surface, said backing pressure surface being substantially tangent to the portion of the elongated strip between the label stripping surface and the take-up position in said second direction and being spaced from said label stripping surface in said second direction by an amount so as to result in a substantially constant length of the elongated strip of label stock backing being maintained at all times between said supply position and said take-up position.

2. A label stripping apparatus as recited in claim 1, wherein said label stripping surface is described by a line moving parallel to itself in a curve over an angle of substantially 90°.

3. A label stripping apparatus as recited in claim 2, wherein said curve is circular.

4. A label stripping apparatus as recited in claim 3, wherein said first means comprises a first pin extending transversely to said first and said second directions, a portion of the surface of said first pin forming said label stripping surface.

5. A label stripping apparatus as recited in claim 4, wherein said first means further comprises a second pin extending transversely to said first and to said second directions and spaced apart from said first pin, a portion of the surface of said second pin forming said backing pressure surface.

6. In a device for imprinting characters in succession on label stock comprising a plurality of labels removable adhering to and spaced along a front surface of an elongated strip of label stock backing, the backing also having a back surface, the device including a supply reel from which the label stock is dispensed, a take-up reel onto which the label stock is wound after imprinting, a print station located intermediate the supply reel and the take-up reel, a drive capstan and associated pinch roller located between the print station and the take-up reel for moving the label stock, and guide means for directing the label stock from the supply reel past the print station in a first direction to a label stripping surface, and for abruptly changing the direction of travel of the label stock by pressing the back surface of the elongated strip against the label stripping surface and thereafter moving the label stock in a second direction, spaced substantially 90° from the first direction to the drive capstan and associated pinch roller, an improvement comprising:

a backing pressure member located between the label stripping surface and the drive capstans and associated pinch roller in proximity to the label stripping surface and having a surface engaging the front surface of the label stock after the label stock travels across the label stripping surface, said backing pressure member surface being substantially tangent to the portion of the elongated strip between the label stripping surface and the drive capstan and associated pinch roller in said second direction and being spaced from the label stripping surface in the second direction by an amount so as to result in a substantially constant length of the label stock being maintained at all times between the print station and the points of contact between the drive capstan and the associated pinch roller.

7. The improvement as recited in claim 6, wherein said backing pressure member comprises an elongated pin extending transversely to the first and second directions of label stock movement.

8. The improvement as recited in claim 6, for a device including a print station comprising a hammer mechanism located in proximity to the back surface of the elongated strip of label stock backing and a print character member located in proximity to the front surface of the elongated strip of label stock backing, said pressure member comprising a base member secured to the hammer mechanism and an elongated pin upstanding from said base member and extending transversely to the first and second directions of label stock movement.

9. An improved label stripping apparatus for a printing device capable of imprinting characters in succession on label stock comprising an elongated strip of label stock backing having a front surface and a back surface and further comprising a plurality of label removably adhering to and spaced along the front surface of the elongated strip, the printing device including a supply reel from which the elongated strip is dispensed, a take-up reel onto which the elongated strip is wound after imprinting, a print station located intermediate the supply reel and the take-up reel, a drive capstan and associated pinch roller located between the print station and the take-up reel for moving the label stock, and guide means for directing the elongated strip from the supply reel past the print station in a first direction, and, once past the print station, abruptly changing the direction of travel of the elongated strip around the label stripping apparatus to a second direction, spaced substantially 90° from the first direction, and thereafter directing the elongated strip to the drive capstan and associated pinch roller, said label stripping apparatus comprising:

a base member, a first pin upstanding from said base member, and a second pin also upstanding from said base member but separated from said first pin, and means for securing said base member in proximity to the print station so that said first and second pins extend transversely to the first and second directions of movement of the elongated strip, so that said elongated strip abruptly changes its direction of travel from the first to the second directions around a portion of the surface of said first pin, and so that the front surface of the strip engages a portion of the surface of said second pin after the strip has traveled around said first pin, said respective portions of said first and second pin surfaces being substantially tangent to the length of the elongated strip between said first pin and the drive capstan and associated pinch roller in said second direction, and being offset from each other in the second direction so as to result in a substantially constant length of elongated strip being maintained between the print station and the drive capstan and associated pinch roller when said label stripping apparatus is installed.

* * * * *

UNITED STATES PATENT AND TRADEMARK OFFICE

CERTIFICATE OF CORRECTION

PATENT NO. : 4,036,132

DATED : July 19, 1977

INVENTOR(S) : Larry P. Ellefson

It is certified that error appears in the above-identified patent and that said Letters Patent are hereby corrected as shown below:

Column 6, line 51: delete "able" and insert therefor —ably—

Column 7, line 2: delete "capstans" and insert therefor —capstan—

Column 7, line 35: delete "label" and insert therefor —labels—.

Signed and Sealed this

*Twenty-fifth* Day of *October 1977*

[SEAL]

*Attest:*

RUTH C. MASON
*Attesting Officer*

LUTRELLE F. PARKER
*Acting Commissioner of Patents and Trademarks*